United States Patent [19]

Parr

[11] 4,297,565

[45] Oct. 27, 1981

[54] HEATED WINDOW STRUCTURE WITH AN ELECTRICAL CONNECTOR ASSEMBLY

[75] Inventor: David Parr, Aberystwyth, England

[73] Assignee: David Parr & Associates Limited, GB2

[21] Appl. No.: 81,388

[22] Filed: Oct. 3, 1979

[30] Foreign Application Priority Data

Oct. 5, 1978 [GB] United Kingdom ..... 39524/78
Oct. 5, 1978 [GB] United Kingdom ..... 39525/78

[51] Int. Cl.[3] ..... F27B 3/06

[52] U.S. Cl. ..... 219/522; 174/97; 219/203; 219/541; 219/532; 338/316; 339/17 T

[58] Field of Search ..... 219/203, 522, 532, 536, 219/537, 541, 542, 544; 338/316, 318, 322, 326; 174/97, 138 J; 339/17 T, 47 C

[56] References Cited

U.S. PATENT DOCUMENTS 3,029,303 4/1962 Severino ..... 174/97
3,401,369 9/1968 Palmateer et al. ..... 339/17
3,489,884 1/1970 Wuselnski, Jr. ..... 219/522
3,529,074 9/1970 Lewis ..... 219/522 X
3,976,855 8/1978 Altmann et al. ..... 219/532

FOREIGN PATENT DOCUMENTS 930445 7/1973 Canada .
45622 5/1962 Poland ..... 174/97
2017465 10/1979 United Kingdom ..... 219/203

*Primary Examiner*—Volodymyr Y. Mayewsky
*Attorney, Agent, or Firm*—Lerner, David, Littenberg & Samuel

[57] ABSTRACT

An electrical connector assembly including an elongate resilient synthetic resin channel member for attachment to a vehicle window, the channel member having therein a longitudinally extending channel of re-entrant cross-section. An elongate electrically conductive part is arranged to be received as a snap fit in said channel, whereby one or more conductive heating elements can be trapped between said part and the wall of said channel in electrical connection with said part. The channel member has a surface which supports said part within the channel in a position spaced from the base of the channel in a direction towards the open face of the channel.

10 Claims, 6 Drawing Figures

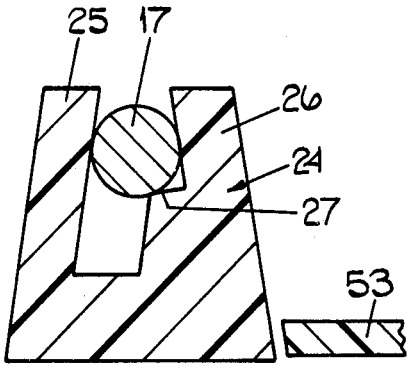
FIG.4.
FIG.5.
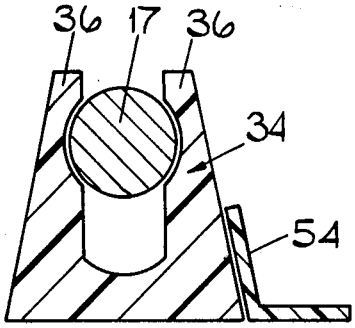
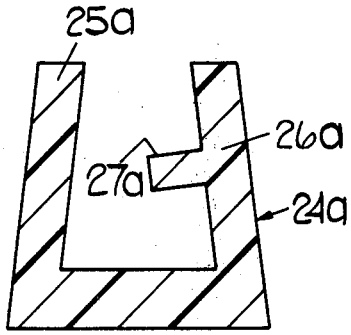
FIG.6.

HEATED WINDOW STRUCTURE WITH AN ELECTRICAL CONNECTOR ASSEMBLY

This invention relates to an electrical connector assembly for use in making an electrical connection to a plurality of heating elements in a vehicle window heater.

It has previously been proposed to make electrical connection to a plurality of heating elements in a vehicle window heater by means of a connector assembly comprising an elongate resilient synthetic resin member which is attached to the window and has therein a channel of re-entrant substantially U-shaped cross-section. An electrically conductive part was received as a snap fit in the channel trapping between itself and the wall of the channel regions of the heater elements whereby electrical connection was established between the conductive part and the elements. The previously proposed arrangement was found to be disadvantageous in that if the channel of U-shaped cross-section was of sufficient flexibility to facilitate insertion therein of said part then frequently the grip of said member on said part was inadequate to ensure a good electrical connection between the said part and the heater elements and it is an object of the present invention to provide a connector assembly wherein this problem is minimised.

An electrical connector assembly according to the invention includes an elongate resilient synthetic resin channel member for attachment to a vehicle window, the channel member having therein a longitudinally extending channel of re-entrant cross-section, and, an elongate electrically conductive part arranged to be received as a snap fit in said channel, whereby one or more conductive heating elements can be trapped between said part and the wall of said channel in electrical connection with said part, the channel member including a surface which supports said part within the channel in a position spaced from the base of the channel in a direction towards the open face of the channel.

Preferably said surface is the upper surface of a rib extending along the length of the base of the channel and projecting upwardly towards the open face of the channel between the side walls of the channel.

Alternatively said surface extends, at least in part, laterally with respect to the depth direction of the channel from a side wall of the channel.

Where a connector assembly as specified above is used in a window heater the associated heater elements will follow the plane of the window surface until they reach a corner defined between the window surface and the outer suface of the channel member whereupon the elements will be bent around the corner to follow the surface of the channel member. The elements are vulnerable to damage at the corner during cleaning of the window particularly if the elements bridge the corner rather than closely following the surfaces of the corner, and it is a further object of the present invention to minimise this problem.

Accordingly, preferably the connector assembly includes a clamping member for attachment to the channel member and/or the surface upon which heater elements associated in use with the assembly are supported and arranged to overlie the elements in the region of the corner defined in use between said surface and the channel member.

Desirably the clamping member carries an adhesive layer whereby the member can be adhesively secured to the channel member and/or said surface.

The invention further resides in a window heater comprising a plurality of heater elements for adhesive attachment to a window and a connector assembly as specified above for making an electrical connection to one end of each of the heater strips.

Conveniently said elements are in strip form and the window heater further includes a second connector assembly as specified above for making electrical connection to the other end of each of the heater strips.

The invention still further resides in a window equipped with a heater as specified in either of the two preceding paragraphs.

One example of the present invention is illustrated in the accompanying drawings wherein:

FIGS. 4, 5 and 6 are cross-sectional views respectively of alternative connector assemblies.

Figure 1:
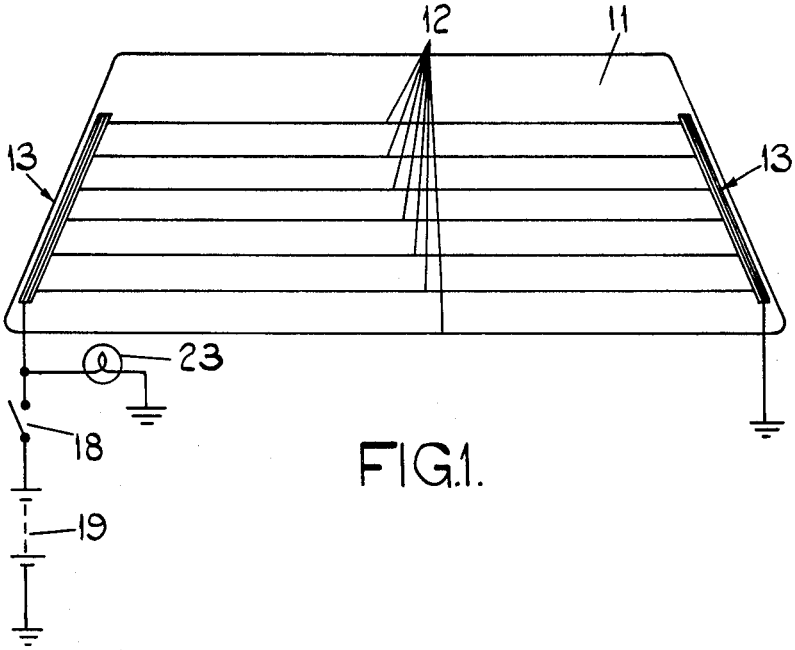
FIG. 1 is a diagrammatic representation of a vehicle window heater.

Referring to the drawings, the vehicle window heater is applied to a vehicle window 11, conveniently the rear window of the vehicle. The heater includes six strips of metal, conveniently nickel-chrome or cupro-nickel tape which extend in parallel spaced relationship across the width of the window 11. Each tape 12 is secured to the inner surface of the window 11 by means of an adhesive, and electrical connections are made to the six tapes 12 by two electrical connector assemblies 13. The connector assemblies 13 are identical, and each comprises a moulded synthetic resin channel member 14 secured to the window 11 adjacent a lateral edge thereof by means of adhesive 15. The channel member 14 is secured to the window 11 with its open face outermost, and the longitudinally extending channel 14*a* of the channel member 14 is of re-entrant cross-section, that is to say has an open face which is narrower than the maximum width of the channel within the member. The side walls 16 of the channel are resilient, and thus can grip between them a conductive metal bar 17. By virtue of the re-entrant nature of the channel 14 the bar 17 is engaged in the channel 14 as a snap fit along the length of the channel.

The channel members 14 are applied to the transverse edges of the window 11 prior to applying the heater strips 12 to the window. The heater strips 12 are applied to the window and their end regions overlie the open face of each channel 14*a*. Thus when a respective conductive bar 17 is snapped into each channel the ends of the strips 12 are pressed down into the channel and the strips are trapped between the bar 17 and the side walls 16 of the channel member 14. Thus each bar 17 makes an electrical connection to one end of each of the strips 12. As mentioned above each of the strips 12 is secured to the window 11 by means of an adhesive layer 20. This adhesive is carried by the strips, but it will be recognised that within each channel member 14 the adhesive coated surface of the strips is presented to the electrically insulating channel walls 16, and the exposed conductive face of each of the strips 12 engages, and thus makes electrical connection with, the respective bar 17.

One of the bars 17 is electrically connected to earth, while the other of the bars 17 is electrically connected through a manually operable switch 18 to one pole of the vehicle battery 19, the other pole of the vehicle battery 19 being earthed. A point intermediate the switch 18 and the bar 17 is electrically connected through a warning lamp 23 to earth, so that upon closure of the switch 18 to energise the heater strips 12 the lamp 23 is also illuminated.

It will be recognised that provided that the channel 14*a* is re-entrant, then it could otherwise be of a simple U-shape in cross-section. However, if this were the case, then the bar 17 would descend to engage the base of the channel, and the flexure of the walls 16 of the channel would be concentrated adjacent the root of each of the walls. This is a rather undesirable arrangement, since concentrating the stress in this manner can result in failure of the channel to grip the bar 17 adequately, and this in turn of course can lead to a poor electrical connection between the bar and the heater strips 12. In order therefore to ensure that the walls 16 grip the bar 17 in a manner to achieve a good electrical connection between the bar 17 and the heater strips 12, the base 22 of the channel is integrally formed with a longitudinally extending rib 22 which projects towards the open face of the channel, and lies midway between the side walls 16. The upper surface of the rib 22 supports the bar 17 so that the bar 17 is located adjacent the free ends of the side walls 16. By supporting the bar 17 spaced from the base 21 the stressing of the side walls 16, which of course gives rise to the grip of the side walls 16 on the bar 17, is distributed more evenly along the length of the side walls.

FIGS. 4, 5 and 6 show alternative channels forms wherein the channel has the required re-entrant nature, and also supports the bar 17 spaced from the base of the channel. In FIG. 4 the channel member 24 has one plain side wall 25 and one stepped side wall 26. The step 27 in the side wall 26 provides a surface supporting the bar 17 spaced from the base of the channel. However, this arrangement has two disadvantages by comparison with the arrangement shown in FIG. 2. Firstly it is not symmetrical, and thus is not so easily produced by mass production techniques as is the arrangement shown in FIG. 2, and secondly the provision of the step 27 makes it necessary for the side wall 26 adjacent its root, to be considerably thicker than the side wall 25. Thus, in such an arrangement flexure of the channel member during insertion of the bar 17 will take place predominantly in the side wall 25, and in effect, therefore the side wall 25 will be subject to a greater stress than either of the side walls 16 of the channel member 14. The member 24*a* shown in FIG. 6 is a modification of the FIG. 4 version in which problem of lack of flexure of side walls 26 is minimised.

Figure 2:
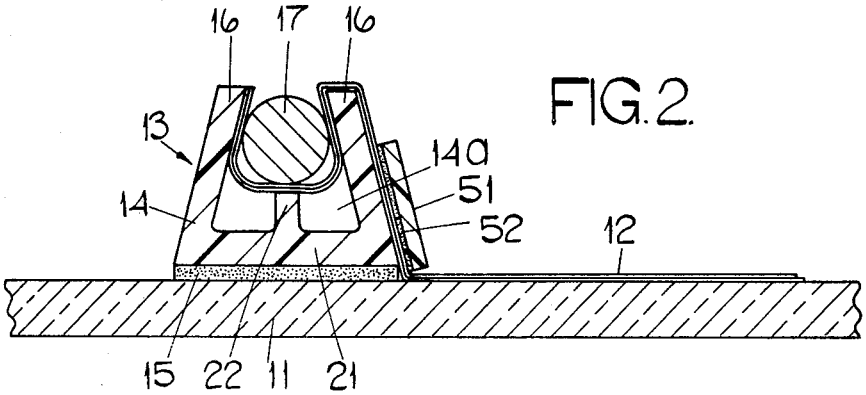
FIG. 2 is a cross-sectional view to an enlarged scale of an electrical connector assembly of the heater shown in FIG. 1.
Figure 3:
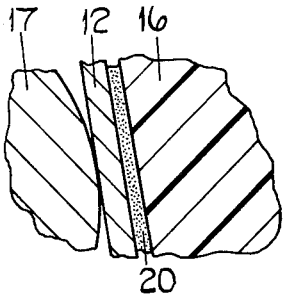
FIG. 3 is a cross-sectional representation to a further increased scale of part of the assembly shown in FIG. 2.

The channel member 34 shown in FIG. 5 does not suffer from the disadvantages described in respect of the channel member 24, but nevertheless, is not, for most applications, preferred to the channel member 14 shown in FIG. 2. The channel member 34 does however fulfill the requirement of supporting the bar 17 spaced from the base of the channel and it does have the required re-entrant nature, both features being provided by the part-circular recesses formed in the mutually presented surfaces of the side walls 36 of the channel member. It will be recognised that the part-circular recesses provide the re-entrant nature to retain the bar 17, and also provide support for the bar 17 to hold it spaced from the base of the channel.

As mentioned above the conductive strips 12 are applied to the window 11 after the channel members have been applied to the window 11. The strips are pressed onto the window 11 between the channel members, and it is extremely desirable that the strips are fitted tightly into the corner defined between the window and the outer surface of the side wall of the channel member. However, it is found that during fitting there is a tendency to bridge this corner by the strips 12 and thus in the finished arrrangement there is at the corner defined between the channel member and the window a strong likelihood of there being a short, unsupported length of each of the strips 12. These short unsupported lengths are susceptible to fracture during cleaning of the inner surface of the window 11 unless great care is taken. In order to minimise this problem, a clamping member is provided. The clamping member can take a number of different forms, three of which are shown in FIGS. 2, 4 and 5, respectively. In FIG. 2 the clamping member 51 is in the form of a synthetic resin strip of length equal to the length of the channel member 14, and provided on one face thereof with a layer of pressure-sensitive adhesive 52. After the strips 12 have been laid along the surface of the window 11 between the channel members 14 but before the end regions of the strips have been pressed onto the channel members 14, the clamping member is pressed down into the corner defined between the window 11 and the channel member with its adhesive surface 52 presented towards the channel member. The clamping member 51 thus traps the strips 12 tightly into the corner and is itself held in position by being adhesively bonded to the strips, and more particularly to the channel member 14 between the strips. In the arrangement shown in FIG. 4, the clamping member 53 again occupies the corner, but is bonded by its adhesive layer (not shown) to the window.

In the arrangement shown in FIG. 5 the clamping member 54 is of L-shaped cross-section and again occupies the corner. The two outermost faces of the L-section are coated with adhesive (not shown) and the clamping member 54 is adhesively secured both to the window 11 and to the channel member.

It will be recognised that alternative forms of clamping member can be devised, on the basis that the function of the clamping member is to trap the wires tightly into the corner defined between the channel members and the window, and thus ensure that the strips are supported in the otherwise vulnerable corner. Moreover, it will be recognised that some means could be provided for snap fitting the clamping member to the channel member although it does appear that the use of adhesive is preferable in terms of cost and simplicity.

It will be appreciated that any of the clamping members shown can be used with each of the channel sections shown and furthermore if desired any of the channel shapes which are shown herein can be used without a clamping member provided that care is taken during assembly of the heater to ensure that the strips are applied tightly into the corner defined between the channel member and the window.

I claim:

1. A window heater comprising:

a plurality of heating elements for adhesive attachment to a transparent window member;

an electrical connector assembly for one end of each of said heating elements, said electrical connector assembly including an elongated resilient synthetic resin channel member for attachment to said window, said channel member having therein a longitudinally extending channel of re-entrant cross-section, and an elongated electrically conductive part arranged to be received as a snap fit in said channel of said channel member so that said one end of each of said heating elements is trapped between said electrically conductive part and the wall of said channel in electrical connection with said electrically conductive part, said channel member including a surface which supports said electrically conductive part within said channel in a position spaced from the base of said channel in a direction towards the open face of said channel.

2. A window heater as claimed in claim 1 wherein said heating elements are in strip form having first and second ends, and further including a pair of said electrical connector assemblies, one of said electrical connector assemblies making electrical connection to one end of each of said heating elements and the other of said electrical connector assemblies making electrical connection to the other end of each of said heating elements.

3. A window heater as claimed in claim 1 wherein said surface is the upper surface of a rib extending along the length of the base of the channel and projecting upwardly towards the open face of the channel between the side walls of the channel.

4. A window heater as claimed in claim 1 wherein said surface extends at least in part laterally with respect to the depth direction of the channel from a side wall of the channel.

5. A window heater as claimed in claim 1 wherein said channel member includes a support section for attachment to the window and an upstanding wall section extending from said support section away from the window, said support section and said upstanding wall section defining a corner of said channel member, and further including a clamping member for attachment to at least one of said channel member and the window, said clamping member being arranged to overlie said heating elements in the region of said corner.

6. A window structure equipped with a heater, said window structure comprising:

a transparent window member;

a plurality of heating elements adhesively secured to said window member; and an electrical connector assembly for making electrical connection with one end of each of said heating elements, said electrical connector assembly including an elongated resilient synthetic resin channel member for attachment to said window member, said channel member having a longitudinally extending channel of re-entrant cross-section, said channel of re-entrant cross-section including a base portion and an open face spaced therefrom, and an elongated electrically conductive part arranged to be received as a snap fit in said channel so that said one end of said heating elements is trapped between said electrically conductive part and the wall of said channel in electrical connection with said electrically conductive part, said channel member including a surface which supports said electrically conductive part within said channel in a position spaced from said base of said channel in a direction towards said open face of said channel.

7. A window structure as claimed in claim 6 wherein said heating elements are in strip form having first and second ends, and further including a pair of said electrical connector assemblies, one of said electrical connector assemblies making electrical connection to one end of each of said heating elements and the other of said electrical connector assemblies making electrical connection to the other end of each of said heating elements.

8. A window structure as claimed in claim 6 wherein said surface is the upper surface of a rib extending along the length of the base of the channel and projecting upwardly towards the open face of the channel between the side walls of the channel.

9. A window structure as claimed in claim 6 wherein said surface extends at least in part laterally with respect to the depth direction of the channel from a side wall of the channel.

10. A window structure as claimed in claim 6 wherein said channel member includes a support section for attachment to said window member and an upstanding wall section extending from said support section away from said window member, said support section and said upstanding wall section defining a corner of said channel member, and further including a clamping member for attachment to at least one of said channel member and said window member, said clamping member being arranged to overlie said heating elements in the region of said corner.

* * * * *